United States Patent [19]

Habeeb et al.

[11] Patent Number: 4,764,294

[45] Date of Patent: Aug. 16, 1988

[54] LUBRICATING OIL (PNE-500)

[75] Inventors: Jacob J. Habeeb; William H. Stover, both of Sarnia, Canada

[73] Assignee: Exxon Research and Engineering Company, Florham Park, N.J.

[21] Appl. No.: 66,608

[22] Filed: Jun. 26, 1987

Related U.S. Application Data

[63] Continuation-in-part of Ser. No. 832,021, Feb. 24, 1986, abandoned.

[51] Int. Cl.[4] ..... C10M 137/14; C10M 135/18; C10M 135/24

[52] U.S. Cl. ..... 252/32.7 E; 252/33.6; 252/48.2

[58] Field of Search ..... 252/32.7 E, 48.2

[56] References Cited

U.S. PATENT DOCUMENTS

| | | | |
|---|---|---|---|
| 3,513,094 | 5/1970 | Farmer et al. | 252/32.7 E |
| 3,923,669 | 12/1975 | Newingham et al. | 252/32.7 E |
| 3,929,654 | 12/1975 | Brewster et al. | 252/48.2 |
| 4,178,258 | 12/1979 | Papay et al. | 252/32.7 E |

FOREIGN PATENT DOCUMENTS

| | | | |
|---|---|---|---|
| 597283 | 1/1945 | United Kingdom | 252/48.2 |

*Primary Examiner*—William R. Dixon, Jr.
*Assistant Examiner*—Ellen McAvoy
*Attorney, Agent, or Firm*—John W. Ditsler

[57] ABSTRACT

A lube oil composition having improved antiwear and friction reducing properties, together with a method for manufacturing same, are described. The lube oil comprises:

A. a basestock;
B. a metal phosphate;
C. a metal carbamate; and
D. a para alkyl hydroxy-aryl sulfide.

15 Claims, 1 Drawing Sheet

LUBRICATING OIL (PNE-500)

CROSS-REFERENCE TO RELATED APPLICATIONS

This application is a continuation-in-part of U.S. Ser. No. 832,021, filed Feb. 24, 1986, now abandoned.

BACKGROUND OF THE INVENTION

1. Field of the Invention

The present invention is directed to an improved lube oil formulation. More specifically, this invention is directed to a lube oil composition having a reduced phosphorus content which exhibits satisfactory anti-wear and friction reducing properties.

2. Description of Related Art

In current lube oil formulations for internal combustion engines, phosphorus-containing compounds such as zinc dialkyldithiophosphate (ZDDP), are added to the lube oil formulation to provide improved anti-wear properties. However, it has been found that phosphorus from the phosphorus-containing compounds becomes deposited on the catalyst in catalytic converters, thereby decreasing the efficiency of catalytic converters over time and also deactivating the oxygen sensors. As a result, vehicle manufacturers have recommended that engine oil contain reduced phosphorus contents. At the present time, automotive lube oils typically contain a maximum of about 0.10 to about 0.14 weight percent phosphorus. To reduce the rate at which catalytic poisoning occurs by phosphorus, it would be advantageous to reduce the phosphorus content of the lube oils to about 0.08 weight percent, or lower.

The use of metal phosphates and metal carbamates in lube oils is known. For example, U.S. Pat. No. 4,178,258 discloses that molybdenum bis(dialkyldithiocarbamate) can significantly improve the friction and wear properties of lube oil, particularly when the oil contains zinc dialkyldithiophosphate (ZDDP). The patentee also discloses that other additives such as sulfurized calcium phenates may be present in the lube oil. However, the addition of sulfurized calcium phenates to a lube oil is not desirable because it may reduce the fuel economy and anti-rust properties of the lube oil.

As another example, U.S. Pat. No. 3,513,094 discloses the use of metal dithiocarbamates in lube oils in combination with antimony dihydrocarbyldithioate. Patentees also mention the use of sulfurized sperm oil as a lube oil additive.

Yet another example is U.S. Pat. No. 3,923,669 which discloses the use of zinc dialkyldithiophosphate and a neutral barium salt of a petroleum sulfonate diaryldithiocarbamate in a lube oil. However, the use of neutral barium salts of a petroleum sulfonate is not desirable because of barium's toxicity.

In addition, Japanese Patent Publication J54,113,604 discloses the combination of molybdenum sulfide-oxide, ZDDP and dialkyldithiocarbamate in a lubricant for internal combustion engines.

The use of alkyl phenyl sulfides in lube oils is also known (see U.S. Pat. No. 3,929,654 and U.K. Pat. No. 591,283). However, applicants have discovered that not all alkyl phenyl sulfides are effective antiwear agents.

In view of the disadvantages associated with the aforementioned prior art, it would be desirable to have available a simple yet convenient method for decreasing the concentration of phosphorus-containing compounds, such as zinc dialkyldithiophosphate, in lubricating oil so as to decrease the rate at which phosphates are deposited on the catalyst while maintaining superior antiwear capability. It also would be desirable to provide a lube oil having anti-wear and friction reducing properties comparable to presently available lube oils, but having a reduced phosphorus content as well. This applicants have done by discovering a particular combination of compounds, which when added to a lube oil basestock, result in a lube oil having enhanced anti-wear properties.

SUMMARY OF THE INVENTION

Now according to the present invention, it has been found that a lube oil which comprises a basestock, a metal phosphate, a metal carbamate and certain alkyl hydroxy-aryl sulfides (namely a para alkyl hydroxy-aryl sulfide) has improved antiwear and friction reducing properties at lower phosphorus contents than a lube oil in which the three additive compounds are not present.

The present invention also is directed to a method for improving the anti-wear and friction reducing properties of a lube oil basestock which comprises adding to the basestock of an effective amount of:

A. a metal phosphate;

B. a metal carbamate; and,

C. a para alkyl hydroxy-aryl sulfide.

BRIEF DESCRIPTION OF THE DRAWING

The single FIGURE represents a plot of average cam lobe wear as a function of time for varying lube oil additive combinations.

DETAILED DESCRIPTION OF THE INVENTION

Figure 1:
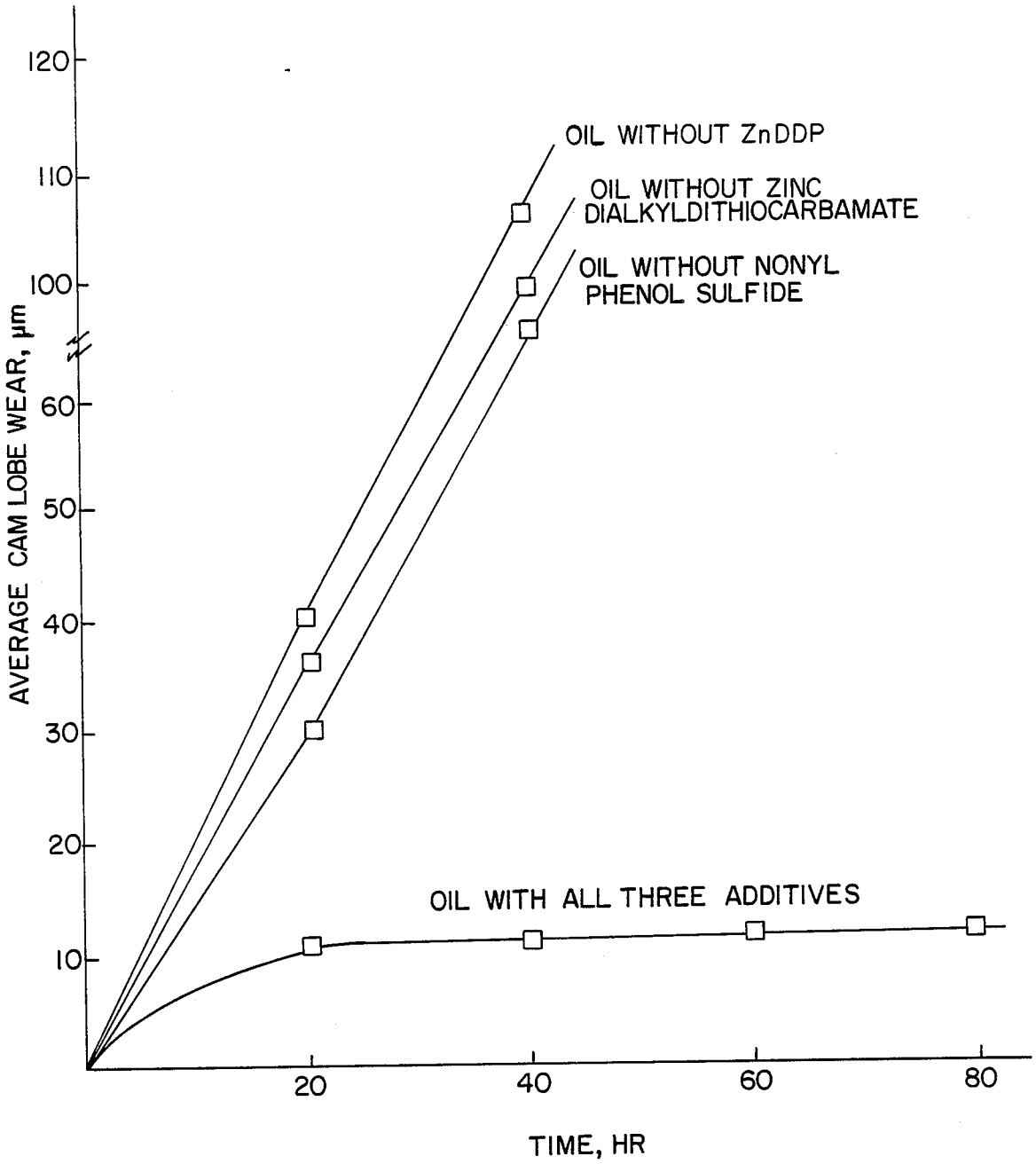

The present invention is directed at a lube oil composition (and method of making same) which comprises a basestock, a metal phosphate, a metal carbamate, and a para alkyl hydroxy-aryl sulfide. The lubricant thus formed has a reduced phosphorus content, yet exhibits satisfactory anti-wear and friction reducing properties.

The basestock utilized in the present invention is not critical and may be selected to achieve the desired final properties of the lube oil. The basestock may be natural or synthetic.

The metal phosphate used in the present invention preferably comprises a metal selected from the group consisting of Group IB, IIB, VIB, VIIIB of the Periodic Table and mixtures thereof. A metal dithiophosphate (MDTP) is a preferred metal phosphate, with a metal dialkyldithiophosphate being particularly preferred. Nickel, copper, zinc and mixtures thereof are particularly preferred metals. The alkyl groups preferably comprise $C_3$–$C_{10}$ alkyls. Particularly preferred compounds are zinc dialkyldithiophosphates. These compounds and the methods for making same are well-known by those skilled in the art. The concentration of the metal phosphate (particularly the metal dialkyldithiophosphate) should range between about 0.1 and about 1.0 weight percent, based upon the lube oil, so that the concentration of phosphorous is less than 0.08 weight percent, preferably 0.05 weight percent or less, of the lube oil. Preferably the concentration of the metal phosphate will range between about 0.3 and about 0.6 weight percent.

The metal carbamate preferably comprises a metal dithiocarbamate wherein the metal is selected from the group consisting of Group IB, IIB, VIB and VIIIB of the Periodic Table and mixtures thereof. Preferred metals include zinc, nickel and iron, with zinc dithiocarbamate being particularly preferred. The concentration of the metal carbamate may range between about 0.1 to about 1.3 weight percent, preferably between about 0.2 and about 0.8 weight percent, based on lube oil. Zinc dithiocarbamate (ZDTC) is readily available as an article of commerce.

The present invention requires the presence of para alkyl hydroxy-aryl sulfides, preferably those in which the alkyl groups range between $C_6$ and $C_{18}$. Ortho alkyl hydroxy-aryl sulfides have been found to be ineffective as an additive in the present invention. Para nonyl phenol sulfide is a particularly preferred compound. The concentration of the para alkyl hydroxyaryl sulfide may range between about 0.2 and about 2.0 weight percent, preferably between about 0.4 and about 0.8 weight percent, based on lube oil. Para nonyl phenol sulfide (NPS) is well-known by those skilled in the art and is readily obtainable as an article of commerce.

EXPERIMENTAL PROCEDURE

The following comparative examples and examples demonstrate the utility of the present invention, and are not intended to limit the scope of the claims appended hereto. The tests comprised valve train wear tests utilizing a Ford 2.3 liter engine with the pistons and connecting rods removed. The engine was driven with an 11.2 KW (15 horsepower) DC drive motor through a 1.2 timing belt drive. The engine was equipped with Oldsmobile valve springs (146.5–148.3 KG) to increase the load between the cam lobes and the followers. Both oil and coolant circulation were accomplished by use of the engine mounted pumps. All test runs were made at 90° C. oil temperature, 90° C. coolant temperature, approximately 331 kPa oil pressure and an engine speed of 1,000 plus or minus 6 rpm.

During operation, wear is generated on the lobes of the cam shaft and followers due to the sliding contact. As in the sequence V-D test described in ASTM Test No. STP 315H-Part 3, the disclosure of which is incorporated herein by reference, wear is defined as the reduction of the head-to-toe measurement at the point of maximum lift on the cam shaft. A pre-measured cam shaft is measured at various time intervals during the test to establish the reduction in the head-to-toe distance, i.e. the degree of wear. The tests were conducted with a commercially available lubricating oil from which the anti-wear additive had been removed and which were modified somewhat to simulate actual used oil conditions.

COMPARATIVE EXAMPLE 1

In this test 0.41 weight percent of zinc dialkyldithiophosphate (ZDDP) and 0.80 weight percent of zinc dithiocarbamate were added to the lube oil noted above. The engine was run for only 40 hours to prevent engine seizure due to high wear which had been detected after 20 hours of operation. The average cam lobe wear was 29.5 micrometers (um) and 95.4 um after 20 and 40 hours, respectively.

COMPARATIVE EXAMPLE 2

A test similar to that described in Comparative Example 1 was run in which the lube oil contained 0.41 weight percent of ZDDP and 0.80 weight percent of para nonyl phenol sulfide. Again, the test was run for 40 hours after which the cam lobe was measured. The average cam lobe wear was 36 um and 96.2 um after 20 and 40 hours of testing, respectively.

COMPARATIVE EXAMPLE 3

This Comparative Example was conducted similar to that of Comparative Example 1, but in this test 0.80 weight percent of zinc dithiocarbamate and 0.41 weight percent para nonyl phenol sulfide were added to the lube oil. The average cam lube wear was 39.9 um and 106 um after 20 and 40, respectively.

EXAMPLE 1

This test was conducted in a manner similar to that described hereinabove for the Comparative Examples. However, in this test the lube oil had added thereto 0.41 weight percent zinc dialkyldithiophosphate, 0.30 weight percent zinc dithiocarbamate and 0.50 weight percent para nonyl phenol sulfide. The average cam lobe wear was only 9.2 um, 10.6 um, 11.6 um and 11.6 um after 20, 40, 60 and 80 hours of testing, respectively.

The data obtained in Comparative Examples 1–3 and in Example 1 are plotted on FIG. 1. The average cam lobe wear in micrometers is plotted as a function of time. The data in FIG. 1 and in Table I show that the combination of zinc dialkyldithiophosphate, zinc dithiocarbamate and para nonyl phenol sulfide resulted in lower cam lobe wear than an equal weight of only two of the three additives.

COMPARATIVE EXAMPLE 4

A test similar to that described in Comparative Example 1 was run in which the lube oil contained 0.41 weight percent ZDDP, 0.4 weight percent ZDTC and 0.4 weight percent ortho alkyl hydroxy-aryl sulfide. The engine was run for about 40 hours after which the cam lobe was measured. The average cam lobe wear was found to be 39 and 48 um after 20 and 40 hours, respectively.

COMPARATIVE EXAMPLE 5

A test similar to that described in Comparative Example 1 was run in which the lube oil contained 0.41 weight percent ZDDP, 0.4 weight percent ZDTC and 0.4 weight percent calcium sulphonate. The engine was run for about 40 hours after which the cam lobe was measured. The average cam lobe wear was found to be 34 and 67 um after 20 and 40 hours, respectively.

The data in Comparative Examples 4 and 5 show that when ortho alkyl hydroxy-aryl sulfide and calcium sulphonate each is used with the other two components, there results increased cam lobe wear relative to that obtained when para alkyl hydroxy-aryl sulfides are used.

TABLE I

| | Additive Concentration, Wt. % | | | Total Additive | Average Cam Lobe Wear, Micrometers (um) | | | |
|---|---|---|---|---|---|---|---|---|
| Test Reference | ZDDP | ZDTC | NPS | Concentration, Wt. % | 20 Hr | 40 Hr | 60 Hr | 80 Hr |
| Comp. Ex. 1 | 0.41 | 0.80 | 0 | 1.21 | 29.5 | 95.4 | — | — |
| Comp. Ex. 2 | 0.41 | 0 | 0.8 | 1.21 | 36.0 | 96.2 | — | — |

TABLE I-continued

| Test Reference | Additive Concentration, Wt. % | | | Total Additive | Average Cam Lobe Wear, Micrometers (um) | | | |
|---|---|---|---|---|---|---|---|---|
| | ZDDP | ZDTC | NPS | Concentration, Wt. % | 20 Hr | 40 Hr | 60 Hr | 80 Hr |
| Comp. Ex. 3 | 0 | 0.80 | 0.41 | 1.21 | 39.9 | 106.0 | — | — |
| Example 1 | 0.41 | 0.30 | 0.5 | 1.21 | 9.2 | 10.6 | 11.6 | 11.6 |
| Comp. Ex. 4 | 0.41 | 0.4 | (1) | 1.21 | 39.0 | 78.0 | — | — |
| Comp. Ex. 5 | 0.41 | 0.4 | (2) | 1.21 | 34.0 | 67.0 | — | — |

(1) The third component was 0.4 wt. % of ortho alkyl hydroxy-aryl sulfide.
(2) The third component was 0.4 wt. % of calcium sulphonate.

What is claimed is:

1. A lube oil having improved antiwear properties comprising:

A. a basestock;

B. a metal phosphate;

C. a metal carbamate; and

D. a para alkyl hydroxy-aryl sulfide.

2. The lube oil of claim 1 wherein the metal phosphate comprises a metal selected from the group consisting of Groups IB, IIB, VIB, VIIIB of the Periodic Table and mixtures thereof.

3. The lube oil of claim 2 wherein the metal phosphate is selected from the group consisting of zinc, nickel, copper and mixtures thereof.

4. The lube oil of claim 3 wherein the metal phosphate comprises a metal alkylphosphate.

5. The lube oil of claim 4 wherein the metal alkylphosphate comprises a metal dialkyldithiophosphate.

6. The lube oil of claim 4 wherein the metal dialkyldithiophosphate comprises zinc dialkyldithiophosphate.

7. The lube oil of claim 1 wherein the metal carbamate comprises a metal dithiocarbamate.

8. The lube oil of claim 7 wherein the metal of the metal dithiocarbamate is selected from the group consisting of Groups IB, IIB, VIB, VIIIB of the Periodic Table and mixtures thereof.

9. The lube oil of claim 8 wherein the metal dithiocarbamate comprises a metal selected from the group consisting of zinc, nickel, iron and mixtures thereof.

10. The lube oil of claim 1 wherein the alkyl groups in said para alkyl hydroxy-aryl sulfide ranges between $C_6$ and $C_{18}$.

11. The lube oil of claim 10 wherein the para alkyl hydroxy-aryl sulfide comprises a para nonyl phenol sulfide.

12. A lube oil comprising:

A. a basestock;

B. about 0.1 to about 1.0 wt.% metal dialkyldithiophosphate;

C. about 0.1 to about 1.3 wt.% metal dithiocarbamate; and

D. about 0.2 to about 2.0 wt.% para alkyl hydroxy-aryl sulfide, the concentration of components B, C and D being based on the lube oil.

13. The lube oil of claim 12 comprising:

A. about 0.3 to about 0.6 wt.% metal dialkyldithiophosphate;

B. about 0.2 to about 0.8 wt.% metal dithiocarbamate; and

C. about 0.4 to about 0.8 wt.% para alkyl hydroxy-aryl sulfide, the concentrations of components A, B and C based on the lube oil.

14. A method of improving the anti-wear properties of a lube oil basestock comprising the addition to the basestock of an effective amount of:

A. a metal phosphate;

B. a metal carbamate; and

C. a para alkyl hydroxy aryl sulfide.

15. The method of claim 14 comprising the addition to the basestock of an effective amount of:

A. zinc dialkyldithiophosphate;

B. zinc dithiocarbamate; and

C. para nonyl phenol sulfide.

* * * * *